US005464173A

United States Patent [19]

Sharrow et al.

[11] Patent Number: 5,464,173

[45] Date of Patent: Nov. 7, 1995

[54] SUBASSEMBLY MEANS

[75] Inventors: Joseph F. Sharrow; Samuel R. Hardy, both of King George, Va.

[73] Assignee: The United States of America as represented by the Secretary of the Navy, Washington, D.C.

[21] Appl. No.: 357,959

[22] Filed: Dec. 16, 1994

[51] Int. Cl.[6] ..... F42B 10/14

[52] U.S. Cl. ..... 244/3.3; 244/3.28

[58] Field of Search ..... 244/3.3, 3.27, 244/3.28, 3.29

[56] References Cited

U.S. PATENT DOCUMENTS

| | | | |
|---|---|---|---|
| H905 | 4/1991 | Rottenberg | 244/3.28 |
| 3,333,790 | 8/1967 | Durand, Jr. | 244/3.3 |
| 3,643,599 | 2/1972 | Hubich | 244/3.27 |
| 3,880,383 | 4/1975 | Voss et al. | 244/3.27 |
| 3,978,790 | 9/1976 | Sandelius | 244/3.27 |
| 4,175,720 | 11/1979 | Craig | 244/3.28 |
| 4,560,121 | 12/1985 | Terp | 244/3.28 |
| 5,211,357 | 5/1993 | Leidenberger | 244/3.28 |

FOREIGN PATENT DOCUMENTS

| | | | |
|---|---|---|---|
| 389358 | 9/1990 | European Pat. Off. | 244/3.28 |
| 2256622 | 12/1992 | United Kingdom | 244/3.27 |

*Primary Examiner*—Charles T. Jordan
*Assistant Examiner*—Theresa M. Wesson
*Attorney, Agent, or Firm*—Elmer Goshorn

[57] ABSTRACT

Improved collapsible roll or spin-stabilizing fin subassembly means of relatively lightweight molded construction for missile means and the like that is generally made up of base or hub means, a series of four interconnecting fork means and a series of four fin means. The base means is suitably affixed in concentric fashion to the trailing end of the missile means. Each one of the interconnecting means is hingedly connected to its associated radially aligned bifurcated means of the series of four bifurcated means. At the same time, each fork means is biasingly interconnected to its associated bifurcated means so that any fork means is biasingly urged in a trailing or rearward direction, once the missile means is launched, to an outward and inward extended partially rotated position as limited by stop means provided on the base means. Each fin means has a curvature in one direction for facilitating collapsing of each fin means in matching surface-to-surface interengagement between opposed portions of the missile means and the storage/launch container therefor. Also, each one of the fin means is hingedly and biasingly interconnected to the outer end of its associated fork means; such that when the missile means is launched, each fin means is provided with stop means for limiting its rotational movement. By reason of the rearward partially rotated movement of each fork means about one axis together with the limited rotational movement of each fin means about another axis, each fin means is extended from its collapsed position to a preselected rearward extended swept-back rotational position when the missile means as provided on suitable platform means is launched from its container thereon, all for enabling enhanced roll or spin-stabilized rotation of the launched missile means about its axis throughout its trajectory or flight path.

12 Claims, 3 Drawing Sheets

SUBASSEMBLY MEANS

This invention concerns an improved collapsible, roll or spin-stabilizing fin subassembly means for concentric attachment to missile means or the like at the trailing end thereof; and, more particularly, it concerns an improved collapsible, spin-stabilizing fin subassembly means of relatively lightweight molded construction for missile means or the like that are concentrically attached to the trailing end of missile means where each fin means is provided with a preselected curvature in one direction, a preselected chordal and radial extent as well as having a preselected chordal angle and also having a swept-back leading edge angle; all relative to the longitudinal axis of the missile means when the fin means of the subassembly means are extended from a collapsed position to a trailing swept-back position, after the missile means in being provided on suitable platform means is launched from its storage container means thereon, so as to provide enhanced roll or spin stability of the missile means as it rolls about its axis thoughout its trajectory.

BACKGROUND OF THE INVENTION

In the past numerous fin designs have been effected for contributing to the roll or spin stabilization of missile means and the like as it follows its trajectory or flight path once launched from a platform such as, e.g., an aerial platform. For example, U.S. Pat. No. 2,271,280 to Weinert concerns a projectile provided with a plurality of collapsed stabilizing vanes until the projectile is launched from a gun bore. U.S. Pat. No. 3,643,599 to Hubich concerns missile means having combined retractible roll or spin-stabilizing fin means and drag-brake fin means; all for enabling control of the trajectory of the missile means before target impact. U.S. Pat. No. 3,978,790 to Sandelius concerns a sonobuoy having a series of spring biased retractible spin-stabilizing fins and also having a series of retractible drag-brake means for retractably mounting the spin-stabilizing means. When the sonobuoy is launched from a platform and after a predetermined time interval in its trajectory, the extended stabilizing fins are separated from the drag-brake means once the drag-brake means are extended (just before the sonobuoy impacts its target) from a collapsed position to an outward extended position. U.S. Pat. No. 5,211,358 to Bagley discloses missile means having a series of retractible roll or spin-stabilizing fin means that are pneumatically secured in an extended position once the missile means is launched. However, none of the aforediscussed references whether taken alone or in any combination remotely suggest the improved collapsible, roll or spin-stabilizing fin subassembly means of the instant invention for concentric attachment to missile means and the like at the trailing end thereof. The improved subassembly means is advantageously comprised of base or hub means, a plurality of fork means and a plurality of fin means; all components of the subassembly means being of relatively lighweight molded construction. By reason of the double axis relationship and double hinging (pivotal) action of the subassembly means as designed; it advantageously provides efficient, enhanced coin pact storage of the fin means between the missile means and the storage container means when the fin means are collapsed. Also, the fin means upon launch of the missile means are extended from their collapsed storage position rearwardly and outwardly to a uniform swept-back partially rotated position, such that the uniquely extended trailing and swept-back fin means effectively roll or spin stabilize the missile means against yaw and pitch as the launched missile means follows its intended trajectory with greater precision than heretofore possible.

SUMMARY OF THE INVENTION

An object of the invention is to provide an improved collapsible, roll or spin-stabilizing fin subassembly means for missile means and the like with the improved subassembly means being of relatively lightweight molded construction as well as being collapsible in a very compact novel manner between missile means and storage container means manner until the missile means is launched from the storage container means.

Another object of the invention is to provide an improved collapsible, spin-stabilizing fin subassembly means for missile means and the like with the improved subassembly means being concentrically attached to the trailing end of the missile like means for enabling greater stability and accuracy of the missile means as it follows its intended trajectory during flight.

Still another object of the invention is to provide an improved collapsible roll or spin-stabilizing fin subassembly means for missile means and the like with the subassembly means having fin interconnecting means with offset pivotal axes at right angles to each other so as to provide enhanced extension of the fin means from a collapsed position to an enhanced swept-back trailing and partially rotated position thereby enabling greater spin stability of the missile means as it follows its intended trajectory or path during flight.

Other objects and advantages of the invention will become more apparent when taken in conjunction with the attached specification, claims and drawings as will now be described.

DETAILED DESCRIPTION

Figure 1:
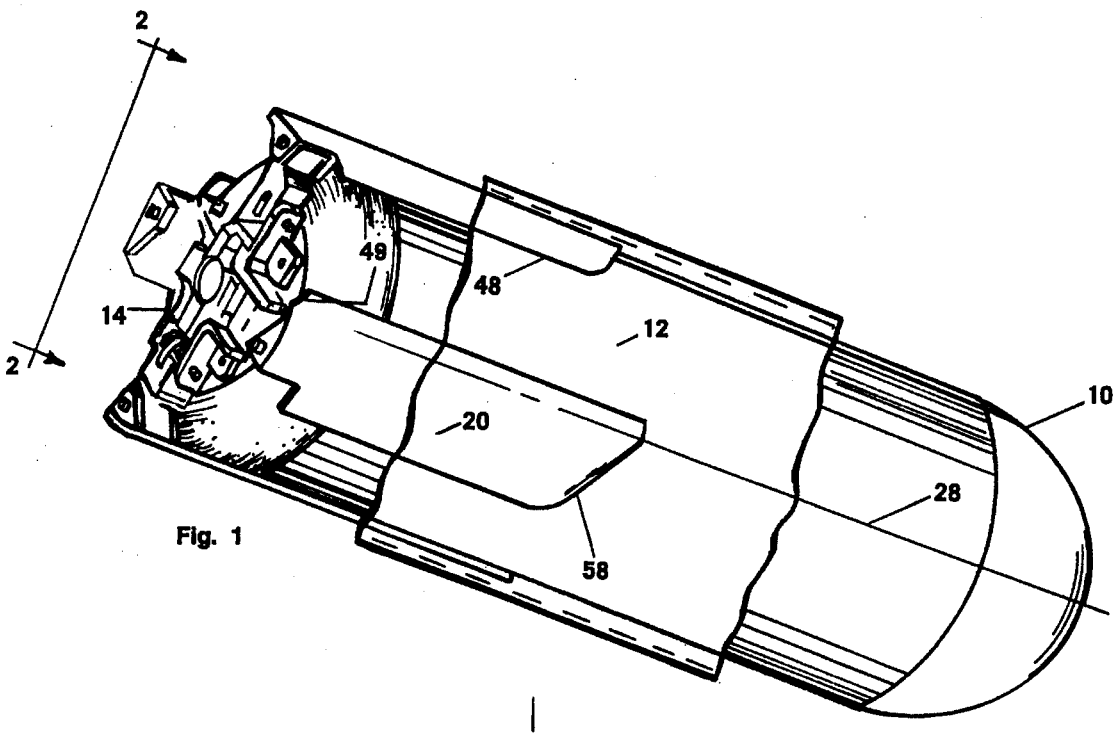
FIG. 1 is a partially fragmented perspective view in dotted and solid lines and it illustrates an embodiment of a missile or the like as stored in a container as well as an inventive embodiment of an attached improved collapsible, roll or spin-stabilizing fin subassembly means therefor.
Figure 2:
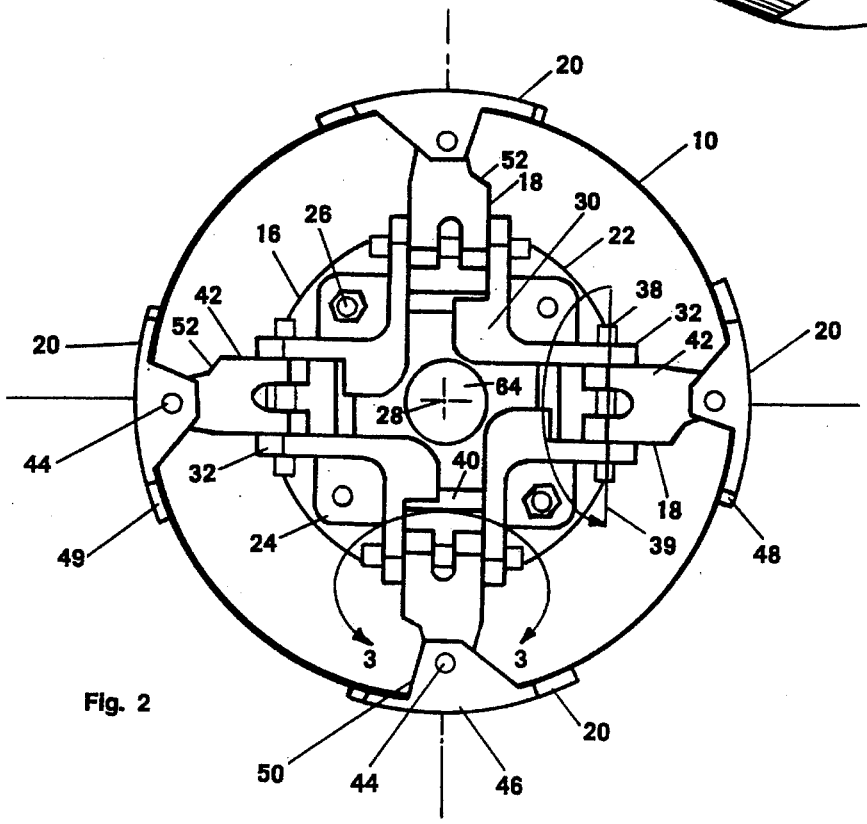
FIG. 2 is an enlarged plan view (with parts removed) of the collapsible subassembly means relative to the missile means as taken along 2—2 of FIG. 1.

With further reference to FIG. 1 of the drawings, missile-like means 10 in conjunction with its surrounding storage/launch container means 12 is advantageously associated with an improved collapsible roll or spin-stabilizing fin subassembly means 14. This subassembly means 14 is disposed in its collapsed condition between the missile means and storage container means 12. As generally shown in FIG. 2, the improved subassembly means is generally made up of base or hub memos 16, a series of four fork-like interconnecting means 18 and a series of four roll or spin-stabilizing fin means 20. All of the major components of the subassembly means are of molded lightweight construction such as a suitable grade of a carbon composite material or a suitable grade of a thermosetting plastic material, e.g., that utilizes an actual copolymer. As illustrated in FIG. 2, base means 16 is provided with a flat faced circular bottom 22 for seating engagement against the tail or trailing end of missile means 10. The exposed major surface of the bottom portion of the attached base means is provided with a series of four uniformly spaced and circumferentially arranged upstanding boss portions 24 of corresponding shape, each of which is provided with a bore for receiving cap screw means 26 (only two of which are shown for the sake of brevity) for effecting concentric positive attachment of the base means to the trailing end of the missile means in concentric relation to axis 28. Interposed between the bosses 24 is an upstanding portion 30 of star-like or cruciform shape, such that the outer radial ends of the cruciform shaped portion is provided with diametrically opposed bifurcated portions 32 of corresponding shape. Each of the bifurcated portions of the series of four extends radially outward and is uniformly spaced about the circumference of the base means relative to the other bifurcated means of the series.

Figure 3:
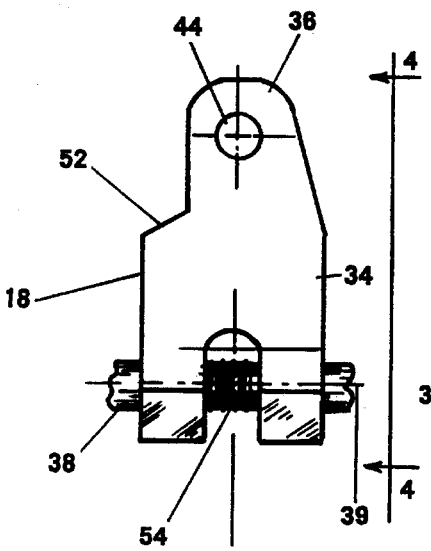
FIG. 3 is an enlarged inverted plan view, with certain parts broken away, of one of the fork interconnecting means of the subassembly means as taken along line 3—3 of FIG. 2.
Figure 4:
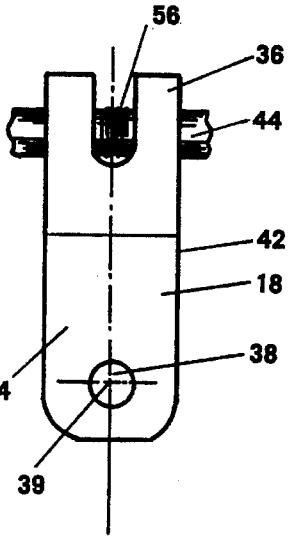
FIG. 4 is a side elevational view with certain parts broken away as taken along line 4—4 of FIG. 3.
Figure 8:
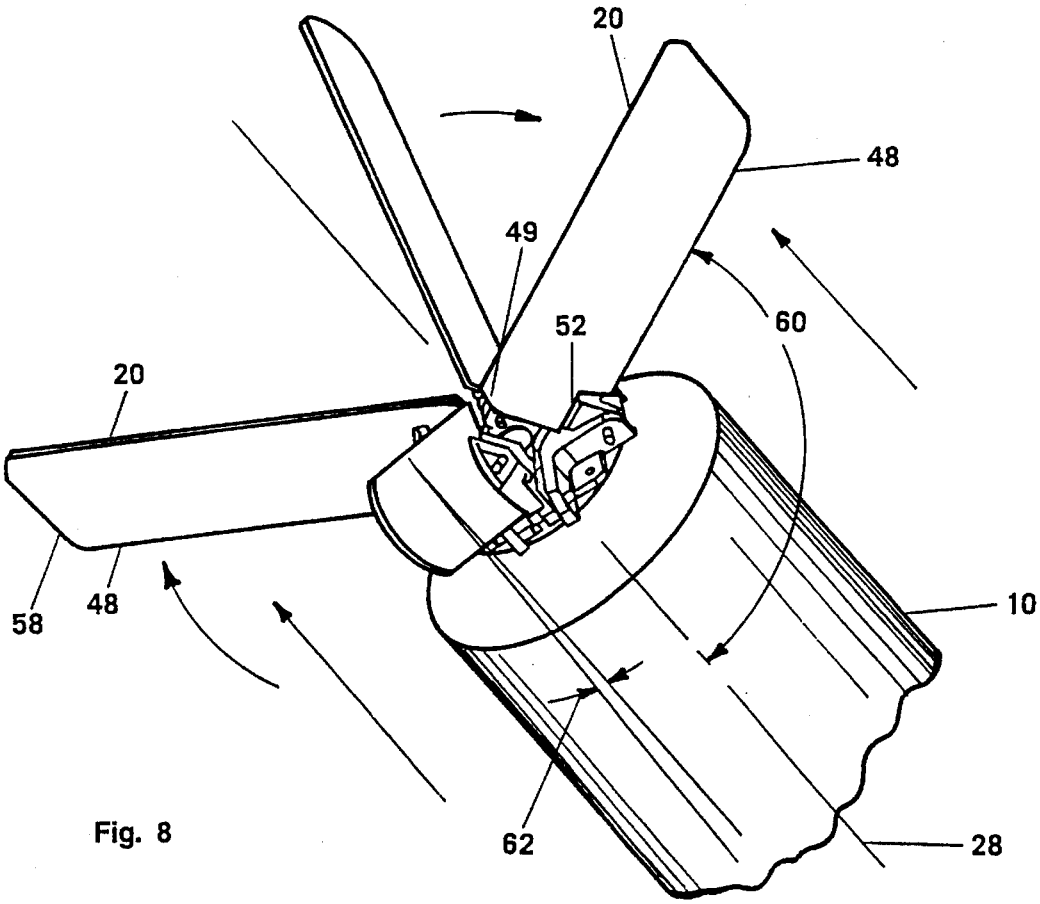
FIG. 8 is another fragmented perspective of a launched missile means; and it illustrates the improved subassembly means in a partially rotated and fully rearward extended swept-back position relative to the missile means for effecting enhanced roll or spin stabilizing of stone as it rolls about its axis in following its intended trajectory.

A series of four fork-like means 18 are pivotally interconnected in unique fashion between fin means 20 and bifurcated means 32 as will now be described. As best shown in FIGS. 3–4, inner enlarged end 34 of fork means 18 is forked while outer (upper) relieved end 36 thereof is also forked but at right angles to the inner end thereof. Inner forked portion 34 of any forked means is provided with an axial aligned opening in each forked end thereof for bearingly and rotatably receiving an interconnecting shaft 38. At the same time, the exposed outer ends of shaft 38 are connected to opposed aligned openings provided in any bifurcated means 32 associated with its respective fork means 18, such that the outer ends of shaft means 38 are affixed to its associated bifurcated means. Hence, any fork means is pivotally (hingedly) connected to its associated bifurcated means 32 about axis 39 of shaft 38 as best shown in FIG. 2. In order to provide ample clearance between any fork means 18 and its associated base means 16, the inner end of fork means 18 is relieved or curved as shown in FIG. 4. To limit the pivotal movement of any fork means 18 from a collapsed position immediately adjacent the trailing end of the missile means to an outward and inward partially rotated position (when fin means 20 are advancing from a collapsed position to an outward extended and swept-back position), the base means is provided with precisely relieved wall means to precisely limit and stop the outward and inward partially rotated and trailing position of any fork means relative to and away from its base means 16. As best shown in FIG. 2, outer surface portion 40 at the base or inner portion of any bifurcated means 32 is relieved approximately 30 degrees relative to an imaginary vertical plane that is parallel to missile axis 28. This relieved surface portion 40 of any bifurcated means 32 at the base or inner portion thereof is impacted by surface 42 of its associated fork means 18 when the fork means is partially rotated to its trailing outward and inward convergent position after missile means 10 is launched from its container means 12. In other words, all fork means 18 when in their outward/inward position converge relative to each other as best shown in FIG. 8.

Figure 5:
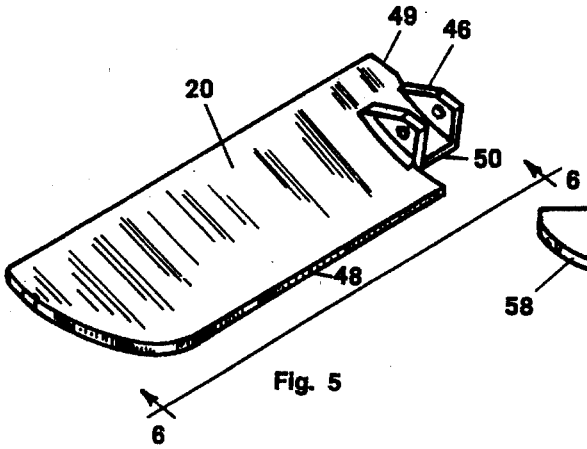
FIG. 5 is a perspective view of one of the fin means of the improved subassembly means.
Figure 6:
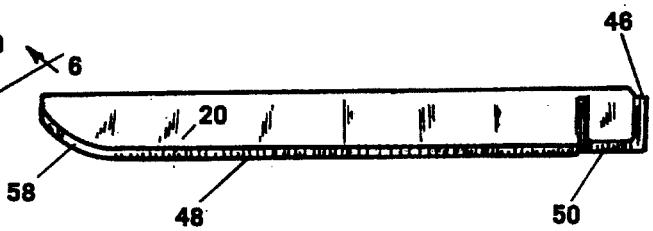
FIG. 6 is a side elevational view as taken along line 6—6 of FIG. 5.

As aforementioned, the outer end of any fork means 18 is provided with a reduced fork means 36 rotated 90 degrees relative to the fork means at its inner end as best shown in FIG. 3. Relieved portion 36 of any fork means 18 is provided with aligned openings for bearingly and rotatably receiving pivot shaft 44. Opposed outer ends of shaft 44 are inserted in aligned openings of associated channel-shaped bracket means 46 of any fin means 20 and these shaft ends are affixed to the outer ends of its associated bracket means 46 thereof as best shown when FIGS. 2 and 5 are taken together. The inner end of any fin means at its leading edge 48 (when the fin means are in a swept-back outward extended and partially rotated position) is relieved to provide a fin rotational stop means edge 50 that is planar aligned with the bottom of bracket means 46 of any fin means 20. When any fin means is in its outward extending, swept-back trailing and partially rotated position, stop means 50 of any fin means impacts its associated relieved shoulder impact surface 52 at the outer end of its associated fork means 36 as best shown in FIG. 8.

Figure 7:
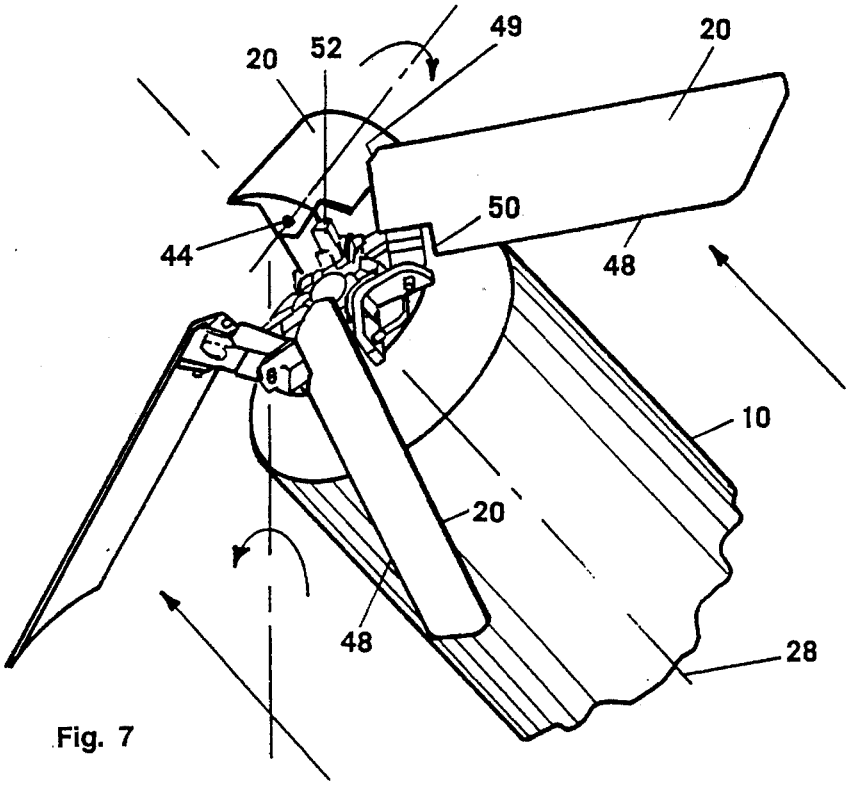
FIG. 7 is a fragmented perspective view of missile means after initial launch from its storage container; and it illustrates the improved collapsible subassembly means in a partially extended and rotated position relative to the launched missile means.

Although not heretofore mentioned, shaft means 38 and 44 are provided with separate torsion spring means 54 and 56 for interconnecting its shaft means and the associated inner and outer ends of fork means 42, whereby any fork means 42 relative to its associated bifiurcated means 32 is biasingly pivoted from a flat position generally parallel to base means 16 to a partially rotated outward and inward trailing position against base means stop means 40 when the fin means are released from their collapsed position as the missile means in being supported by platform means (not shown) is launched from container means 12 thereon. It is noted here when all fork means 18 are arranged in a flat position, the fork means generally lie in a common radial plane that is at a right angle to to missile axis 28 as best illustrated in FIG. 2. Simultaneously with the fin means being released from a collapsed position as the missile means is being launched from container means 12, each fin means 20 is biasingly pivoted frown a collapsed position to a swept-back outward and partially rotated trailing position where each fin means stop means 50 abuts stop means 52 of its associated fork means 18 at the outer end thereof. At the stone time, the fin means are being released from a collapsed position (as the missile means is being launched), torsion spring means 56 associated with each fin means 20 cause partial rotation about shaft means 44 in clockwise (background) and counterclockwise (foreground) directions (as viewed in FIG. 7) of any fin means 20 from a collapsed circumferential position between missile means and surrounding container means to an outwardly radially extended swept-back trailing and partially rotated position relative to the axis of the launched missile means and the trailing end thereof. Hence, by reason of the cooperative action of stop means 40 and 42 of associated base means 16 and the associated inner end of any given fork means 18 together with the cooperative stop means 50 and 52 of any given fin means and the associated outer end of any fork means 18, each fin means 20 is precisely pivoted from a collapsed storage position to a uniformly swept-back trailing and partially rotated outwardly extended radial position. Such a unique rearward extended position of the fin means is effected as the result of the biasing interconnection and radial offset relation of shafts 38 and 44 and associated spring means 54 and 56 as well as the orthogonal relationship therebetween so as to assure an enhanced roll or spin-stabilized trajectory (flight path) of launched missile means in reaching its target.

As is further evident in FIG. 5, each fin means 20 is of uniform radial and chordal extent. At the same time, each fin means means 20 has a predetermined curvature in one direction coincident with its chordal extent, such that its radius of curvature of the inner concave surface of any fin means substantially corresponds to the outside radius of any missile means 10. At the same, the radius of curvature of the outer convex surface means of any fin means 20 substantially corresponds to the radius of inside surface means of container means 12. Accordingly, such radius of curvature between the concave/convex surfaces of the fin means assures matching surface-to-surface engagement between the fin means and the missile means as well as between the fin means and the surrounding storage container means. At the same time, any material selected for the fin means should be such as not to cause any binding engagement between any fin means and the interior of the storage container means especially when any missile means with collapsed fin means thereabout is launched from its container means. Moreover, the outer radial edge of any fin means is relieved at its intersection with forward leading edge 48 thereof so as to present a smooth curvilinear edge to any air stream when the missile is launched so as not to adversely affect the aerodynamic stability of the missile means throughout its trajectory. Also, the inner but outwardly disposed comer of any fin means 20 is beveled at 49 so as to preclude any abutment and interference when all of the fin means are in any outward extended position as shown in FIG. 8.

In one reduction to practice, improved subassembly means 14 is preferably composed of a suitable lightweight molded plastic material while any shaft means are preferably formed from a suitable nonferrous alloy such as aluminum or any alloy thereof. At the same time, each fin means when disposed in its swept-back trailing and partially rotated position (after missile launching) had a swept-back angle of about 135 degrees (as indicated at 60 in FIG. 8) from its leading edge 48 to axis 28 of missile means 10. Moreover, inasmuch as the concave surface of any fin means 20 directly faces any air stream when being biased from a collapsed storage position to a swept-back trailing and partially rotated position, leading edge 48 of each fin means is tilted slightly outward relative to its trailing edge so as to provide a chordal angle of about 5 degrees (as indicated at 62) relative to axis 28 of missile means 10. In other words, this chordal angle can also be defined by the fact that the forward and leading edge of any fin means determines a plane. At the same time, the trailing edge of any fin means together with the longitudinal axis of any missile means defines another plane. Accordingly, these planes in both intersecting the trailing edge of any fin means define chordal angle 60 as lying in a plane perpendicular to both intersecting planes and with the angle plane extending between opposed inner faces of the intersecting planes. Such limited tilting of each fin means 20 assures ample and uniform rolling or spiraling in a clockwise direction of both the fin means and the missile means together about missile means axis 28 as viewed in FIG. 8. As indicated in FIG. 5, such tilting of the fin means also assures the generation of minimal drag acting on the roll or spin-stabilized launched missile means as it follows its trajectory. By reason of the fin means being relatively thin in thickness and of molded construction it requires little or no machining before use. Although not heretofore mentioned, base means 14 is provided with a concentric aperture 64 for not only minimizing weight but also being of assistance in handling any base means during its formation as manufactured. By virtue of the swept-back trailing portion of the extended fin means, it enhances stability because of increased distance of the fin means' moment and relative to the missile means' center of gravity as well as the swept back leading edge of any fin means immediately counteracts any instability of the missile means in attempting to depart from its intended flight path by presenting a greater radial extent of any fin means leading edge to an air stream when any extended fin means pivots in a direction towards the missile means axis as the result of any flight instability Obviously many modifications and variations of the present invention are possible in light of the above teachings, it is therefore to be understood that within the scope of the appended claims, the invention may be practiced otherwise than as specifically described.

What is claimed is:

1. Improved collapsible, spin-stabilizing fin subassembly SA means for attachment to missile means as provided on platform support means, storage/launch container means on the platform support means for surrounding and enclosing the missile means prior to launch therefrom, said subassembly SA means comprising:

base means, a series of four fork means and a series of four fin means, the base means being concentrically affixed to the trailing end of the missile means and having a series of four bifurcated means formed therein, each bifurcated means of the series of four extending in a radial direction and also each bifurcated means being arranged about the circumference of the base means in equidistant relation to each other, each of the fork means being pivotally and biasingly interconnected about an axis to its associated bifurcated means for pivoting from a collapsed position to an outward extended trailing and partially rotated inward position when all the fork means are in a collapsed position they are arranged in a common plane generally transverse of the axis of the missile means and also are arranged adjacent to the trailing end of the missile means as the missile means is stored in storage container means and when the fork means are in an extended outward trailing and partially rotated inward position each of the fork means are in a convergent relation to each other after the missile means has been launched from its storage container means, and each of the fin means being pivotally and biasingly interconnected about another axis to its associated fork means such that each of the fin means extends from its collapsed position between the missile means and its container means to its outward extended swept-back trailing and partially rotated position when the missile means is launched from its container means so that the outward trailing and partially rotated inward position of the fork means together with the outward extended trailing swept-back and partially rotated position of the fin means causes roll stabilization of the missile means about its axis as the missile means follows its trajectory after launch.

2. Improved SA means as set forth in claim 1, wherein each of the fork means in being biasingly and pivotally interconnected to its associated bifurcated means is effected by torsion spring means.

3. Improved SA means as set forth in claim 1, wherein each of the fin means in being biasingly and rotatably interconnected to its associated fork means is effected by torsion spring means.

4. Improved SA means as set forth in claim 1, wherein each fork means pivots about its respective axis relative to its associated bifurcated means; and wherein a pivot axis of each fork means of the series all lie in a common plane that is arranged at an angle to the axis of the missile means.

5. Improved SA means as set forth in claim 1, wherein each of the fin means and its associated fork means pivots about another axis that lies in a plane common with the axis of the missile means and in parallel relation thereto when each fin means is in a collapsed position between the missile means and its associated container means prior to launch of the missile means therefrom.

6. Improved SA means as set forth in claim 1, wherein the base means is provided with a series of four relatively spaced aperture means for receiving a series of four cap screw means for effecting concentric attachment of the base means to the trailing end of the missile means.

7. Improved SA means as set forth in claim 1, wherein the base means is provided with concentric aperture means for minimizing the weight of the base means.

8. Improved SA means as set forth in claim 1, wherein the base means is comprised of stop means associated with each bifurcated means for positively and precisely uniformly limiting the rotation of each fork means from a collapsed position to a partially rotated and trailing inward/outward position when the missile means is launched frown said storage container means.

9. Improved SA means as set forth in claim 1, wherein each fin means has stop means associated with its respective fork means for limiting its extended swept-back trailing and partially rotated position when the fin means is released from its collapsed position between its associated missile means and surrounding storage container means upon the missile means being launched from its container means.

10. Improved SA means as set forth in claim 1, wherein each fin means has formed therein a preselected curvature in one direction for facilitating matching surface-to-surface interengagement between opposed portions of the missile means and each fin means and also between the container means and each fin means when each fin means is interfitted between the missile means and the container means upon the fin means being collapsed between the missile means and the storage container means during storage of the missile means in the container means.

11. Improved SA means as set forth in claim 1, wherein each fin means forms a swept-back angle of approximately 135 degrees between its leading edge and the axis of the missile means when each fin means is disposed in its extended swept-back trailing and partially rotated position.

12. Improved SA means as set forth in claim 1, wherein the leading edge of each fin means when in its outward extended swept-back trailing and partially rotated position is rotated outwardly relative to its trailing edge as well as about an axis between each fin means and its associated fork means whereby each fin means is tilted outwardly between its leading and trailing edges so as to define a chordal angle of approximately 5 degrees such that the chordal angle for any given tilted fin means can be defined as extending between a plane that includes the trailing and leading edge of any given tilted fin means and a radial plane that includes the missile means axis and the trailing edge of any given tilted fin means.

* * * * *